US010709309B2

(12) United States Patent
Lutz et al.

(10) Patent No.: US 10,709,309 B2
(45) Date of Patent: Jul. 14, 2020

(54) DISHWASHER COMPRISING A DRYING UNIT

(71) Applicant: BSH Hausgeräte GmbH, Munich (DE)

(72) Inventors: Stephan Lutz, Sontheim (DE); Johannes Büsing, Emersacker (DE); Markus Wecker, Gundremmingen (DE)

(73) Assignee: BSH Hausgeräte GmbH, Munich (DE)

( * ) Notice: Subject to any disclaimer, the term of this patent is extended or adjusted under 35 U.S.C. 154(b) by 266 days.

(21) Appl. No.: 15/521,915

(22) PCT Filed: Oct. 27, 2015

(86) PCT No.: PCT/EP2015/074848
§ 371 (c)(1),
(2) Date: Apr. 26, 2017

(87) PCT Pub. No.: WO2016/071154
PCT Pub. Date: May 12, 2016

(65) Prior Publication Data

US 2017/0311771 A1 Nov. 2, 2017

(30) Foreign Application Priority Data

Nov. 5, 2014 (DE) ..... 10 2014 222 539

(51) Int. Cl.
*A47L 15/00* (2006.01)
*A47L 15/48* (2006.01)
*A47L 15/50* (2006.01)

(52) U.S. Cl.
CPC ..... *A47L 15/0034* (2013.01); *A47L 15/0042* (2013.01); *A47L 15/481* (2013.01);
(Continued)

(58) Field of Classification Search
CPC ..... A47L 15/00–508; A47L 15/486
See application file for complete search history.

(56) References Cited

U.S. PATENT DOCUMENTS

2006/0231122 A1* 10/2006 Stelzer ..... A47L 15/486 134/18
2008/0264458 A1 10/2008 Berner et al.
(Continued)

FOREIGN PATENT DOCUMENTS

CN 101455551 A 6/2009
DE 102013210468 B3 10/2014
(Continued)

OTHER PUBLICATIONS

National Search Report CN 20158000600003 dated Oct. 22, 2018.
(Continued)

*Primary Examiner* — Spencer E Bell
(74) *Attorney, Agent, or Firm* — Michael E. Tschupp; Andre Pallapies; Brandon G. Braun

(57) ABSTRACT

A dishwasher includes a wash container for cleaning dishes, glasses, flatware or similar items to be washed during a program sequence which includes a drying phase or another process phase. The wash container has an inlet opening for inflow of a volume flow of air. The volume flow of air entering the wash container through the inlet opening varies a number of times over the drying phase or the other process phase.

21 Claims, 10 Drawing Sheets

(52) U.S. Cl.
CPC ..... *A47L 15/50* (2013.01); *A47L 2501/10* (2013.01); *A47L 2501/12* (2013.01)

(56) References Cited

U.S. PATENT DOCUMENTS

| | | | | |
|---|---|---|---|---|
| 2011/0120510 | A1 | 5/2011 | Delle et al. | |
| 2011/0120512 | A1 | 5/2011 | Delle et al. | |
| 2011/0139187 | A1* | 6/2011 | Rosenbauer ..... | A47L 15/0007 134/25.2 |
| 2012/0240962 | A1 | 9/2012 | Jerg et al. | |
| 2014/0150286 | A1 | 6/2014 | Jadhav et al. | |
| 2014/0223761 | A1 | 8/2014 | Lee et al. | |
| 2015/0342441 | A1* | 12/2015 | Hahm ..... | A47L 15/481 34/79 |

FOREIGN PATENT DOCUMENTS

| | | | |
|---|---|---|---|
| EP | 2371258 | A2 | 10/2011 |
| JP | H0819502 | A | 1/1996 |
| KR | 100712277 | B1 | 4/2007 |
| WO | 2014174784 | A1 | 10/2014 |

OTHER PUBLICATIONS

National Search Report DE 10 2014 222 539.6 dated Aug. 7, 2015.
International Search Report PCT/EP2015/074848 dated Jan. 26, 2016.

* cited by examiner

DISHWASHER COMPRISING A DRYING UNIT

CROSS-REFERENCES TO RELATED APPLICATIONS

This application is the U.S. National Stage of International Application No. PCT/EP2015/074848, filed Oct. 27, 2015, which designated the United States and has been published as International Publication No. WO 2016/071154 A1 and which claims the priority of German Patent Application, Serial No. 10 2014 222 539.6, filed Nov. 5, 2014, pursuant to 35 U.S.C. 119(a)-(d).

BACKGROUND OF THE INVENTION

The invention relates to a dishwasher, in particular a domestic dishwasher, with a wash container for cleaning dishes, glasses, flatware or similar items to be washed, it being possible for air to be introduced into the wash container by way of at least one inlet opening, in particular a discharge opening, during at least one drying phase or another process phase within a program sequence.

Such assistance with the drying of the items being washed by blowing air into the wash container is known in principle, for example from WO 2010/012659 A2.

BRIEF SUMMARY OF THE INVENTION

The invention deals with the problem of further improving or optimizing the drying of items being washed in the inner chamber of the wash container of a dishwasher, in particular a domestic dishwasher, during at least one drying phase of a program sequence with the smallest possible outlay.

Optionally this should also apply to another process phase, in which air flows into the wash container through at least one inlet opening, in particular a discharge opening. The invention resolves this problem by means of a dishwasher having the features as set out in the claims.

Because according to the first independent claim the volume flow of air for drying the items being washed that can be introduced into or supplied to the wash container through the at least one inlet opening, in particular discharge opening varies or fluctuates a number of times (when considered) over the time period of the drying phase in the wash container, flow conditions result that change a number of times when considered over the time period of the drying phase in the wash container. The volume of air introduced through the inlet opening into the inner chamber of the wash container in each instance per unit of time changes a number of times when considered over the duration of the drying phase. This allows for example phases or time segments of this kind, in which the air flow comes up against a barrier (for example a large or inexpertly loaded dish element), to be separated from phases, in which the air flow passes said barrier. In particular each volume flow has a specifically assigned volume flow value from a first time segment or time point to a next, second time segment or time point of the time period of the drying phase.

When considered over the duration of the drying phase, the volume flow can vary in particular with such steep edges that drying air is introduced into the wash container in a gushing or pulsed manner.

Flow supply or modification means are preferably provided such that volume flow fluctuations of the air flow introduced into the wash container are brought about in a specific manner, in particular in a predefinable manner, when considered over the duration of the respective drying phase. This allows the air flow introduced into the wash container by means of at least one inlet opening to reach local regions or zones in the volume of the inner chamber of the wash container more efficiently or even moving air or an air flow to pass over a larger volume in the wash container than would be the case if the volume flow remained the same or stationary, in other words constant, over the entire drying phase. The drying results for drying items being washed after the end of the drying phase are therefore much better with the inventive dishwasher.

In the version according to the second independent claim, because the exit speed of the air that can be introduced into the wash container at the inlet opening, in particular the discharge opening, varies a number of times over the drying phase, the same advantages are achieved as in the configuration according to the first independent claim. If the cross section of the inlet opening, in particular discharge opening, remains the same, which is the simplest structural solution, the speed change is associated with a volume flow change, so the features of the independent claims are combined. For example a high speed component in the transverse direction means that the air if conveyed a long way from the outlet opening, for example into the region of an opposing corner in the wash container, so that even items being washed that are some distance away are dried efficiently. A low exit speed means that the drying air rises upward more in proximity to the outlet opening instead. The interim speed drop also means that the mean noise level during the drying phase is lower than when there is a constant maximum exit speed.

In particular because the volume flow and/or exit speed of the air entering the wash container by way of the at least one inlet opening, in particular discharge opening, varies a number of times over the predefined duration of the drying phase, the local flow distribution of the air in the wash container varies a number of times during the drying phase. Therefore different flow profiles come into effect anyway over the drying phase, regardless of any sensors—which can be dispensed with completely. Flow vectors that vary locally in both quantity and/or also in direction therefore advantageously result at every point or location in the treatment chamber or inner chamber of the wash container.

If the multiple variation or modification of the volume flow and/or exit speed, when considered over the duration of the respective drying phase, is controlled by way of a sequence program, there is no need for subsequent regulation. The invention therefore demonstrates a high degree of simplicity.

In particular the multiple variation or modification of the volume flow and/or exit speed is preset in a fixed manner by way of a program stored in a, preferably electrical, monitoring facility, in particular control unit, of the dishwasher and therefore requires no external input data, which opens up the abovementioned possibility of dispensing completely with sensors. The inventive dishwasher therefore allows more efficient drying of items being washed in a simple manner, without requiring the deployment of a sensor, e.g. moisture sensor, assigned to the wash container. It is now possible, due to the air flow introduced into the wash container by way of at least one inlet opening, in particular discharge opening, and made to vary or fluctuate in respect of volume flow and/or exit speed during the respective drying phase by means of one or more flow supply or modification means, also to reach local regions in the inner chamber of the wash container that are covered or concealed by the respective items being washed in an adequate manner for any moisture present there to be removed adequately during the drying phase. The inventive dishwasher is therefore significantly more independent of the nature of the items being washed, the quantity of the load of items being washed and/or the manner in which the wash container has been loaded with items to be washed, in respect of its drying compared with a conventional dishwasher, in which the same or a stationary air flow is introduced into the wash container by way of at least one outlet, in particular discharge opening. Therefore for example very large plates, pots or the like have much less negative influence than before on the inflow of moving air even in regions that are not directly in the line of sight of the exit or outflow opening but are concealed or covered by items being washed, such as large plates. The air can therefore be distributed more regularly than before in the inner chamber of the wash container over the entire duration of the respective drying phase. This constantly ensures perfect, efficient drying of the items being washed (when the total duration of the drying phase is predefined) for a plurality of load situations and/or loading configurations of items being washed in the wash container. This can be achieved in a particularly energy-efficient manner when a sorption drying facility is used. The drying period can even optionally be shortened, if desired, without losing too much in the way of drying performance and/or energy efficiency.

The invention functions advantageously with different types of drying, for example also with circulating air drying, exhaust air drying and/or condensation drying.

However the dishwasher can also in particular be provided with a sorption drying facility. During the drying phase air, which has passed through the sorption drying facility, outputting liquid to the sorption means there by way of adsorption, can then be introduced into the wash container to bring about a high level of drying. It is then particularly favorable in the initial phase, i.e. during an initial time of the drying phase, in which the drying air transports away a particularly large quantity of moisture, to operate with a high volume flow and/or a high exit speed, which can generally be reduced during the further temporal progress of the drying phase.

If the volume flow and/or exit speed can (also) be varied by way of different rotation speeds of a blower positioned before the discharge opening, the structural configuration and means of activating such an air flow supply or modification means can be simple and economical. The rotation speed of the blower here is preset so that it can be varied in particular over the program sequence, so that no sensors are required for input data. It is sufficient to provide a simple controller, without requiring a regulating circuit.

It is favorable for the rotation speed of the blower to be kept in a (rotation speed value) interval between at least one, in particular predefinable, maximum and at least one minimum rotation speed during the drying phase, apart from a start-up and run-down phase of the blower, in other words for it not to drop to zero, so that the drying time is used efficiently. Of course a plurality of further rotation speed values can also be approached and passed through as rotation speed maximums and minimums in the respective rotation speed value interval. The interval can be selected such that the noise level on average is below a set limit value. The independence of the controller means that the noise level is the same every time.

It is particularly favorable for the rotation speed to be first raised to a maximum rotation speed at the start of the drying phase and then to be reduced to a minimum rotation speed of the interval. With the abovementioned sorption facilities specifically the quantity of water to be removed at the start of the drying phase is particularly large. This can be managed by the particularly high initial rotation speed during an initial time segment of the drying phase or the drying cycle.

The respectively selected minimum rotation speed (lowest value) and maximum rotation speed (highest value) of the rotation speed modification range set for the rotation speed variation is preferably outside the rotation speed range established during the initial starting up or running down of the blower. The minimum rotation speed is in particular selected from a rotation speed range that is different from zero rpm or revolutions per minute, from which the blower can set a desired operating rotation speed in a defined manner. For the fan types generally used for drying in dishwashers it has been demonstrated in tests that a rotation speed of at least 1500 revolutions per minute is initially favorable from a regulation perspective. This is because many fans, which have what is known as a PMSM electric motor or permanent magnet synchronous motor, can only be set, in particular be regulated, to a desired rotation speed beyond 1500 revolutions per minute. A value between 3000 and 4000 revolutions per minute is preferably selected for the first, lower setpoint rotation speed (lowest value of the rotation speed variation interval) to be set. A value of at least 5000 revolutions per minute, in particular between 5000 and 6000 revolutions per minute, is expedient for the second, upper setpoint rotation speed (highest value of the rotation speed variation interval). The gap between the lower rotation speed and the upper, higher rotation speed is selected in particular to be more than 1000 revolutions per minute. A rotation speed variation between the lowest values and highest values is favorably selected so that it falls within an auditory perception range that is experienced or accepted uncritically by users of dishwashers.

If according to one advantageous development of the invention the rotation speed of the blower passes at least twice through the (rotation speed value) interval between maximum and minimum rotation speed over the drying phase, a major change can be brought about in the air flow so that very different local distributions of the (air) flow in the wash container are achieved. This means that the rotation speed of the blower is switched, in other words varied, a number of times between a first setpoint rotation speed (different from zero) and a second setpoint speed (different from zero) which is different therefrom during the duration of the drying phase.

In particular 2-10 switches between a, preferably predefinable, lower setpoint rotation speed and a, preferably predefinable, upper setpoint rotation speed can be expedient with the blower when considered over the total duration of the drying phase of the respective wash cycle in order to bring about a desired change or variation of the local air flow distribution in the inner chamber of the wash container to a sufficient degree to improve the drying performance of the dishwasher. The time period for the switch between the first setpoint rotation speed and the second setpoint rotation speed, which is different therefrom, is expediently at least 30 secs, in particular between 1 minute and 5 minutes.

The rotation speed profile here can vary in the manner of a sawtooth or sine curve between one or more highest and lowest values over at least part of the drying phase, so that the rotation speed changes constantly from one moment to the next. Alternatively it is also possible for the rotation speed profile to vary in the manner of a step function between one or more highest and lowest values over at least part of the drying phase. There can then be a pause at the start, for example for a time typically of around several minutes, at the highest rotation speed level, to eliminate a particularly large quantity of water.

The respective lowest value of the setpoint rotation speed is more than 5% below the respective highest value of the setpoint rotation speed and therefore significantly above any tolerance fluctuations of a speed-controlled motor. In particular the lowest values for rotation speed are more than 1000 revolutions per minute below the highest values in order thus to achieve major differences in local flow distribution.

In addition or as an alternative to rotation speed variation the volume flow and/or exit speed can (also) be varied by way of at least one activatable closing element assigned to the inlet opening, in particular discharge opening, for example a sector disk with one or more open and closed regions connected after the blower and rotating in the air flow.

The open regions here can extend to different lengths over the periphery in order also to allow significant passage and a large volume flow at the start, which can then be reduced during the course of the drying phase.

At least one movable, mechanical control means, for example a baffle, a variable-direction nozzle, a movable flap or the like, can also be assigned to the outlet opening. This allows the direction of the air being blown in to be changed, as well as the outlet cross section, thus also allowing variation by this means.

According to one expedient development of the invention the inventive variation of the volume flow and/or the exit speed of the air, which enters the wash chamber of the wash container from the respective inlet opening, in particular discharge opening, can also be performed during one or more further process phases of the dishwasher, in particular of an ongoing dishwashing program. Such another process phase can be a desorption phase in the case of a dishwasher fitted with a sorption drying facility, for example. This can be performed advantageously in respect of energy during a wash sub-cycle, for example the cleaning cycle with wash fluid that has to be heated, because then the heat energy produced by a heating facility for desorption can also be used to heat wash fluid for a wash sub-cycle, e.g. a cleaning cycle of the wash cycle of a dishwashing program. Varying the volume flow and/or exit speed allows the air exiting into the wash container from the inlet opening, which is heated by a heating facility deployed for desorption, advantageously to pass over a larger spatial region of the wash chamber enclosed by the wash container and the door and/or to heat the treatment chamber enclosed by the wash container and the closed door of the dishwasher more regularly than would be possible before with a volume flow and/or exit speed that remained constant over the entire desorption time period. This can be associated in particular with greater energy efficiency and/or faster heating of the wash chamber.

Other developments of the invention are set out in the subclaims.

The configurations and developments of the invention described above and/or set out again in the subclaims can—except in the case of obvious dependencies or irreconcilable alternatives for example—be applied individually or in any combination with one another.

BRIEF DESCRIPTION OF THE DRAWINGS

The invention and its advantageous configurations and developments as well as their advantages are described in more detail below with reference to drawings illustrating exemplary embodiments, said drawings representing schematic outlines, in which.

DETAILED DESCRIPTION OF EXEMPLARY EMBODIMENTS OF THE PRESENT INVENTION

Figure 1:
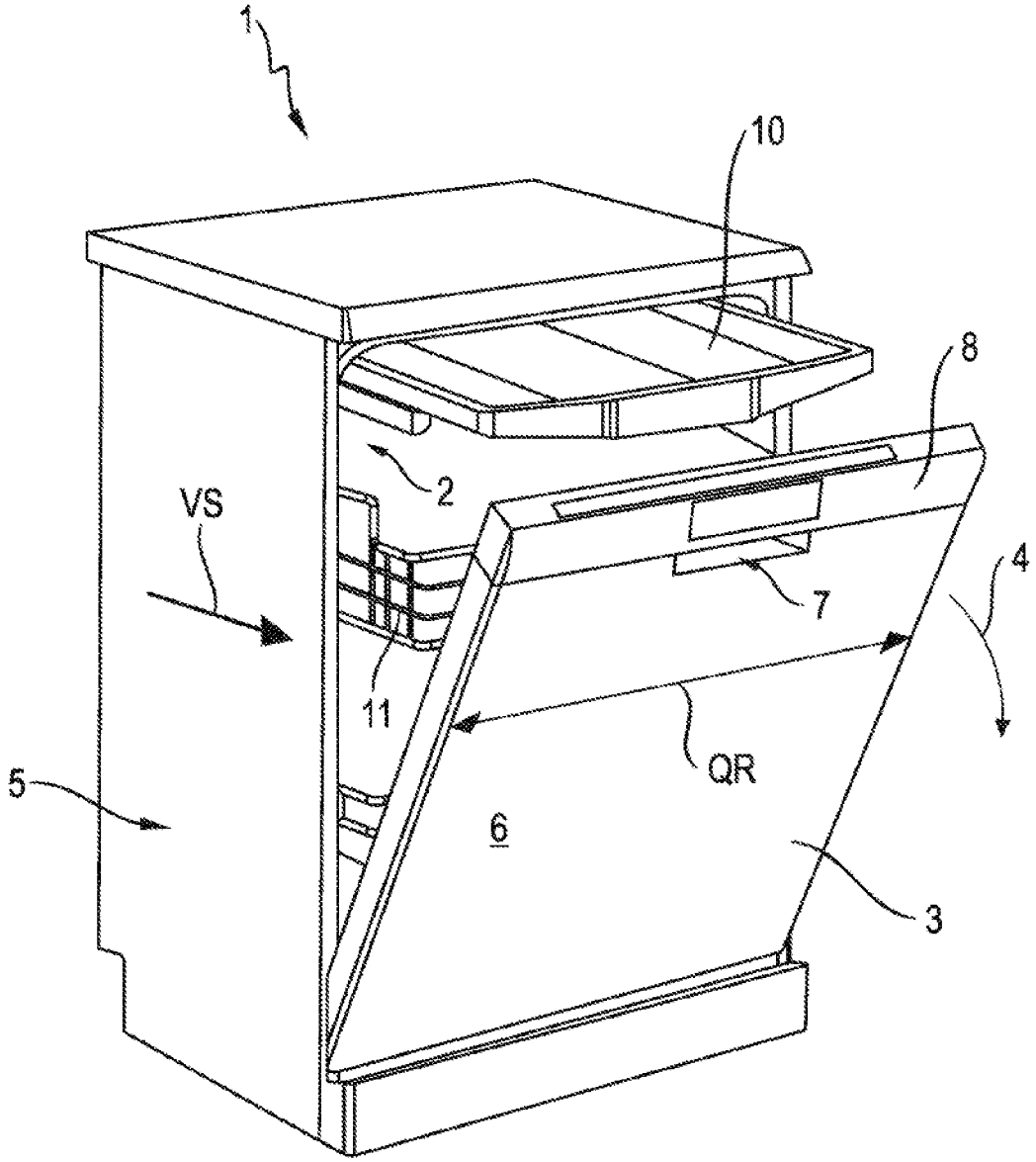
FIG. 1 shows a perspective view of a schematically illustrated dishwasher obliquely from the front with the door partially open.
Figure 2:
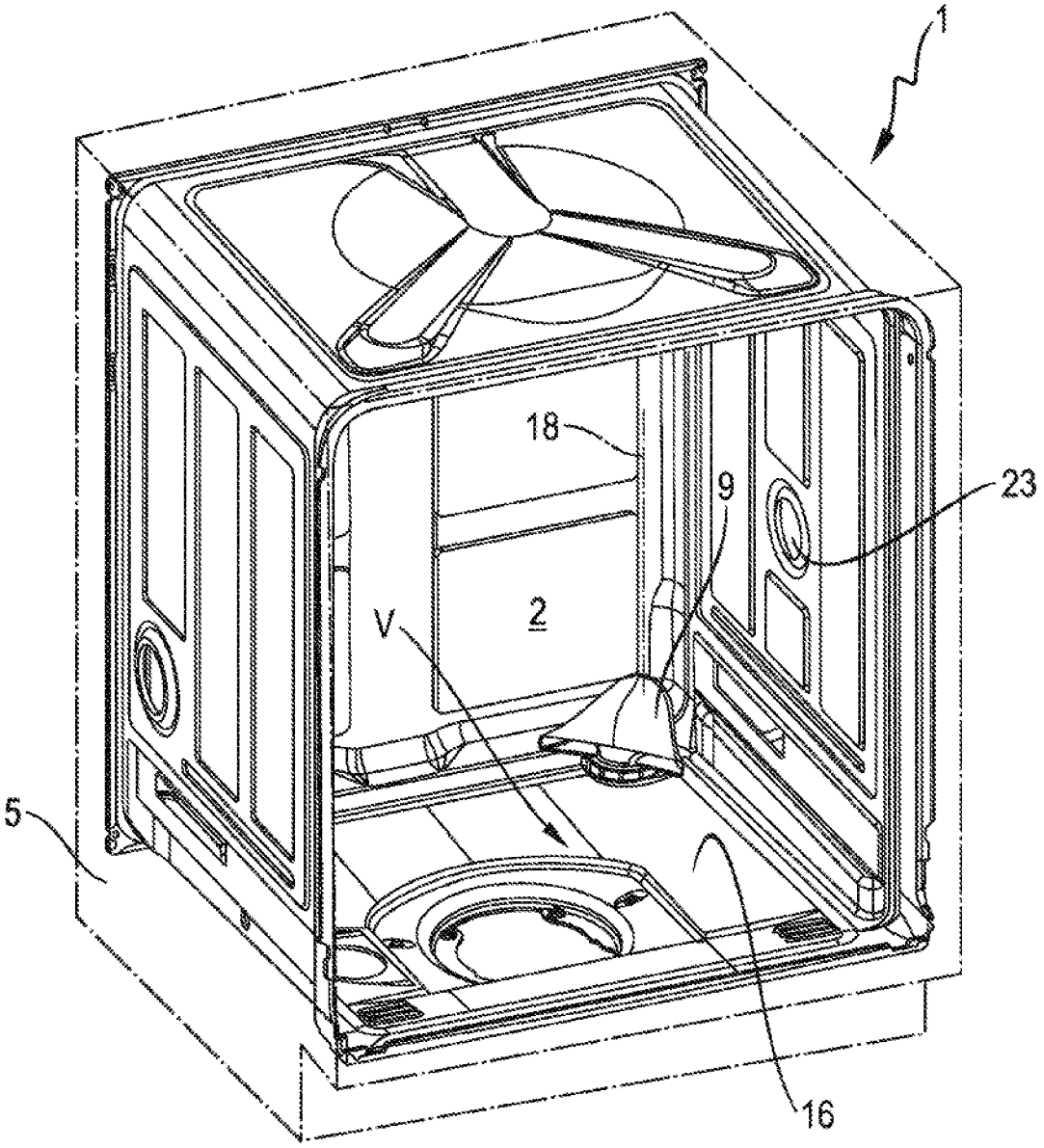
FIG. 2 shows a schematic view of an isolated wash contain obliquely from the front, with a discharge opening for air supplied to the inner chamber of the wash container in the drying phase located in the rear right corner.

Elements of identical function and mode of operation are shown with identical reference characters in the figures. Only those parts of a domestic appliance that are necessary for an understanding of the invention are shown with reference characters and described.

The dishwasher 1 illustrated schematically in FIG. 1 is a domestic dishwasher and has as part of a carcass 5 a wash container 2 for holding items to be washed and processed, such as dishes, pots, flatware, glasses, cooking utensils and the like. The items to be washed here can be held for example in racks 11 and/or a flatware drawer 10 and can be subjected to the action of wash liquor. The wash container 2 can have an at least substantially rectangular footprint with a front face VS facing a user in the operating position. The front face VS here can form part of a kitchen front made up of adjacent kitchen furniture or can also not be related to further furniture in the case of a freestanding appliance.

The loading opening of the wash container can be closed by a door. In the exemplary embodiment here a front loading opening of the wash container 2 can be closed by a door 3 on the front face VS of the dishwasher. Said door 3 is shown partially open and at an angle to the vertical in FIG. 1. In contrast, in its closed position it is upright and roughly vertical. According to the drawing it can be pivoted forward and down in the direction of the arrow 4 about a horizontal axis at the bottom of the front loading opening of the wash container, so that in the fully opened position it is at least approximately horizontal. The walls of the wash container and the closed door enclose a treatment or wash chamber, in which the items to be washed and/or dried can be accommodated.

The door 3 can be provided with a decorative panel 6 on its external front face VS which faces the user and is vertical in the closed position, thereby improving its visual and/or haptic properties and/or matching it to surrounding kitchen furniture.

The dishwasher 1 here is configured as a freestanding or partially integrated or even fully integrated appliance.

An operating panel 8 that extends in the transverse direction QR is assigned to the movable door 3 in its upper region in the exemplary embodiment according to the drawing in FIG. 1, said operating panel 8 possibly comprising a grip opening 7 that is accessible from the front to open and/or close the door 3 manually.

The dishwasher 1 also has an inlet opening, in particular a discharge opening 9, opening into the wash container 2, by way of which air for drying the items being washed can be introduced into the wash container during at least one drying phase within a program sequence. A number of inlet openings, in particular discharge openings 9, could alternatively be possible. The discharge opening 9 here projects into the inner chamber of the wash container 2 at the rear right corner of the base of said wash container 2 when viewed from the front face VS. The discharge opening can alternatively also be provided in the door.

In a first embodiment of the invention the discharge outlet 9 is configured as unmodifiable, in particular as rigid, and therefore needs no positioning elements to move it.

Figure 12:
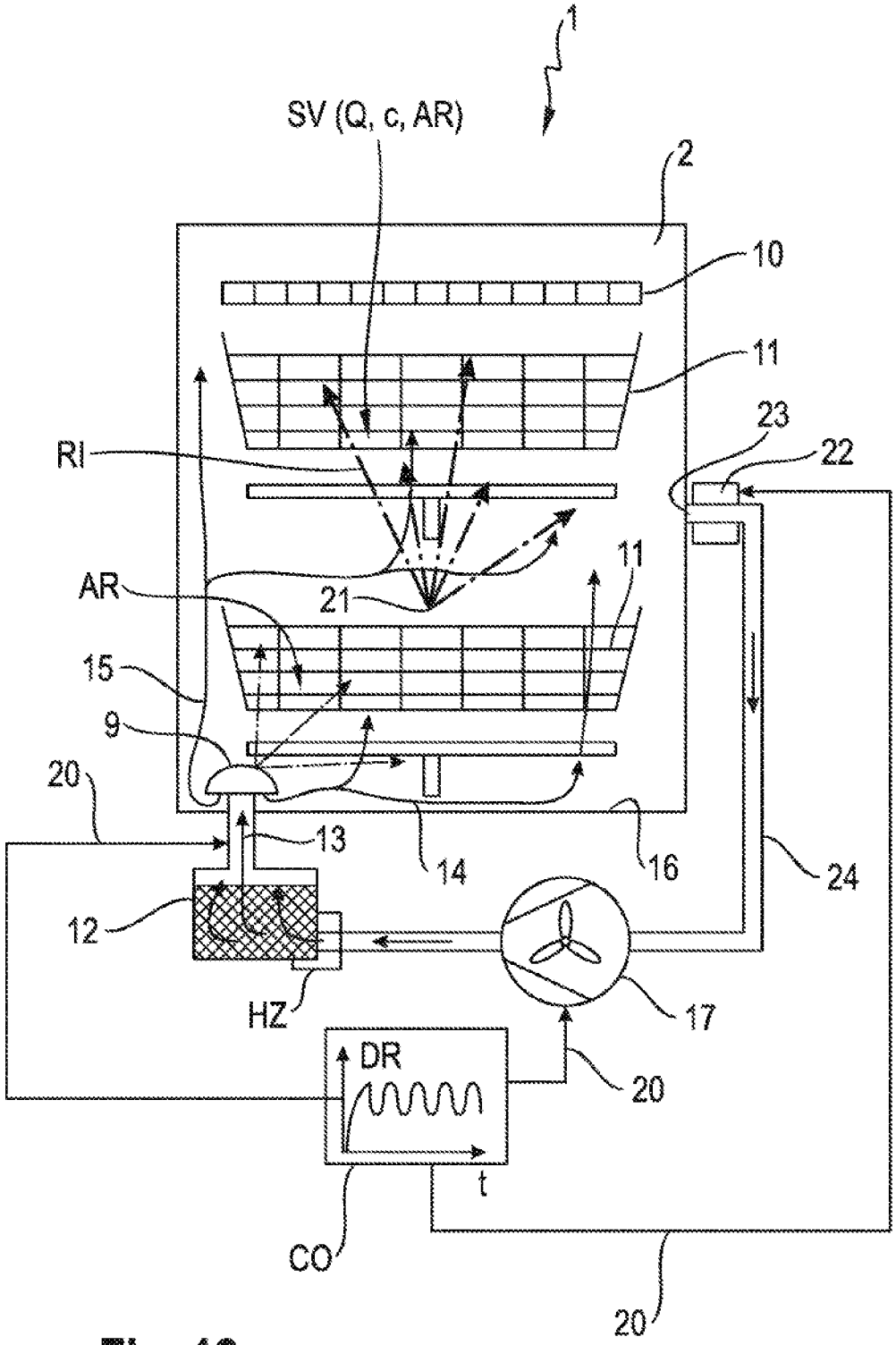
FIG. 12 shows a schematic overall view of a wash container with an air outlet opening, a blower and a sorption drying container in front of a discharge opening.

In the present exemplary embodiment the dishwasher is also provided with a sorption drying facility 12, shown in FIG. 12. During a phase for drying the items being washed or a drying cycle of the wash cycle of an ongoing dishwashing program, air that has passed through the sorption drying facility 12 can be introduced into the wash container 2. The sorption drying facility 12 is preferably a component of an air circulation system. This comprises an air duct 24, which connects an air outlet opening 23 in the wash container 2 to the air outlet or discharge opening 9 in a wall, in this instance in the base part of the wash container 2. The sorption drying facility 12 is inserted into the air duct 24. A blower 17 is inserted before the sorption drying facility 12, between the air outlet opening 23 and the sorption drying facility 12, in other words when viewed in the flow direction of the air, said blower 17 ensuring during the drying operation that air laden with moisture is sucked out of the inner chamber of the wash container into the air duct 24 through the outlet opening 23, conveyed or transported through the sorption drying facility 12, where its sorption material (e.g. zeolite) extracts moisture from the moist air by adsorption and the air that has been dried in this manner is then blown by way of the discharge opening 9 into the inner chamber of the wash container and thus supplied back to it. The air that has been blown in then absorbs moisture from the items being washed again. Continued circulation of the air from the inner chamber of the wash container through the air duct with the sorption drying facility ultimately ensures that the items being washed are dried to the desired degree.

At least one electric heating facility can be provided in the air duct before the sorption drying facility when viewed in the air flow direction and/or in the sorption drying facility for desorbing the sorption material. In the present exemplary embodiment the heating facility is marked HZ in FIG. 12. Desorption here is preferably performed during a wash sub-cycle in which wash fluid is heated, e.g. during the cleaning cycle of a subsequent dishwashing program. The blower is brought into operation here so that air is sucked out of the inner chamber of the wash container through the outlet opening 23 into the air duct 24 and transported through the sorption drying facility 12. In this process the sorption material and/or the air conducted through is/are heated by means of the electric heating facility so that the air absorbs the moisture adsorbed at the sorption material. This dries the sorption material so that it is available in regenerated form for adsorption drying for the drying cycle of a wash cycle of a subsequent dishwashing program.

In order in this version but also in a different configuration to allow air to be blown into the wash container 2 by way of the discharge opening 9, at least one blower or fan 17 is preferably provided as a further part of the air duct 24. This allows moist air that is to be dried to be taken into the air duct 24 from the inner chamber of the wash container 2 by way of the air outlet opening 23 of the wash container during the respective drying phase of a dishwashing program to be performed, to be conducted by way of the input side of said air duct 24 (when viewed in the flow direction of the air) to the sorption drying facility 12 and to be conveyed through this, for the moisture contained in the air to be adsorbed by the sorption material there. The air that has been dried in this manner is then moved in the direction of the discharge opening 9 by way of the downstream sub-segment of the air duct 24 and blown back through this into the inner chamber of the wash container.

Of course the dishwasher can also have a different drying system instead of such an air circulation system with sorption drying facility, said different drying system operating according to an alternative or modified drying principle. For example what is known as exhaust air drying can be provided, with which process air is removed from the wash container for example by way of a process air duct by means of a drying air blower present there, optionally cut or mixed, in other words augmented, there with external air or ambient air, and then blown out of the dishwasher into its surroundings. Instead of a separately provided process air duct provision can optionally also be made for opening the door partially, thereby providing a ventilation gap to allow moist air to escape to the outside. Such removal of internal air from the wash container can expediently be assisted by a fan here. With such variants of exhaust air drying, external air from the surroundings follows into the inner chamber of the wash container by way of an opening in the wash container or door. An inlet opening, in particular discharge opening, for allowing air to flow or be conducted into the inner chamber of the wash container is present here too.

In contrast during circulating air drying the process air duct conducts the process air, which has optionally been cut or mixed with external air, back into the wash container. Alternatively or additionally the process air duct and/or its fan can be provided with a condensation surface to allow condensation drying of moist air flowing past to be brought about there. Optionally ambient air can be conducted past the condensation surface on the outside by way of a fresh air duct to cool it. To this end the fresh air duct can have its own blower or the fan of the process air duct is configured as a shared blower for the process air duct and the fresh air duct.

Additionally there are a plurality of further air drying systems, with which air is conducted or moved—optionally by means of a blower, e.g. 17—through a discharge opening e.g. 9 in a wall of the wash container and/or door into the inner chamber or treatment chamber thereof. If drying is assisted by opening the door to create a gap, in some instances the inlet opening can in particular also be formed by said gap. In a first exemplary embodiment the discharge opening 9 is not movable and has a constant cross section. Versions are described below which differ in this respect and change the flow distribution SV in the wash container 2 by means of mechanical changes to the discharge opening 9.

During a wash cycle the dishwasher runs through different program steps of an ongoing dishwashing program, inter alia at least one drying phase (several are also possible), in which an air flow 13 is introduced into the wash container 2 through the discharge opening 9 to dry the items to be washed that are present therein. The respective dishwashing program therefore deploys one or more fluid-conducting wash sub-cycles and at least one drying cycle.

In each case the local flow distribution 25 of the air in the wash container is varied in that the volume flow Q that can be introduced into the wash container 2 by way of the discharge opening 9 and/or the exit speed c of air 13 for drying items to be washed is/are varied a number of times when considered over the drying phase TG. In the context of the invention volume flow refers in particular to the respective volume of air leaving the opening cross section of the discharge opening per unit of time, i.e. within a time interval. If the discharge opening cannot be modified, the relationship Q=cA applies, where A is the opening cross section of the discharge opening, c is the exit speed and Q is the resulting volume flow in liters per second.

Such a drying phase of the wash cycle performed by the respective dishwashing program of a dishwasher preferably lasts at least 15 minutes, in particular typically multiples of 10 minutes, preferably between 30 and 60 minutes. In the diagrams in FIGS. 3 and 4 a duration of 30 minutes is given by way of example for the drying phase. By varying or changing the volume flow and/or exit speed of the air introduced into the wash container by way of the discharge opening, it is therefore also possible to vary the local flow distribution SV of the air in the wash container a number of times during the drying phase. Examples of this are shown in FIGS. 7 to 10. In other words different local flow distributions of the air in the inner chamber of the wash container therefore result from changes to or variations of the volume flow and/or the flow speed, at which the air exits from the discharge opening.

Figure 7:
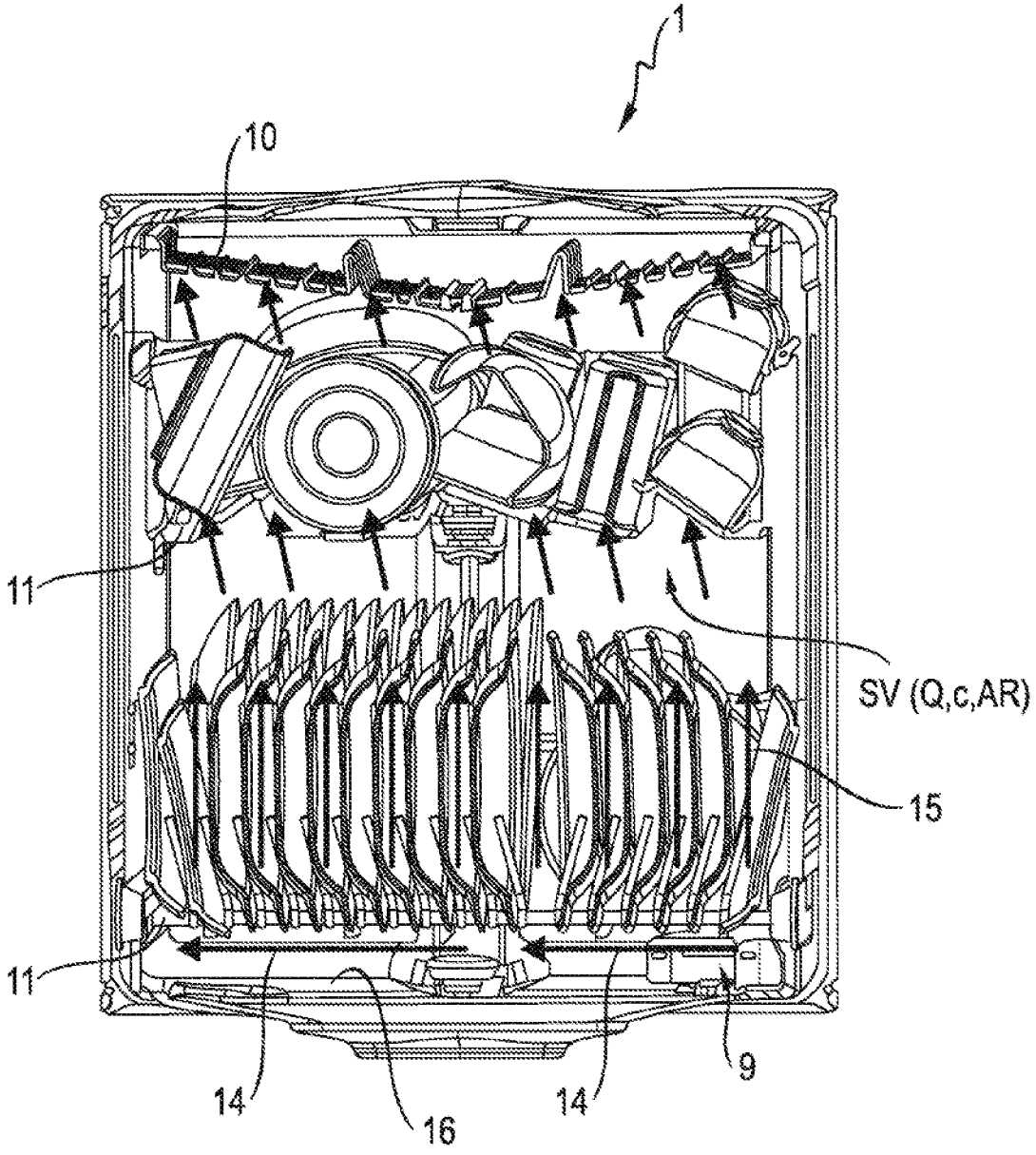
FIG. 7 shows a view from the front into a filled wash container with flow arrows indicating an air flow during the drying phase.

In FIG. 7 a very high outflow speed c of the air from the discharge opening 9 brings about a local air flow distribution with a large transverse flow component 14 in proximity to the base 16 of the wash container, so a large volume flow Q of drying air flows across the entire lower region of the wash container 2 and the vertical flow 17 is distributed over the entire width of the wash container 2.

Figure 8:
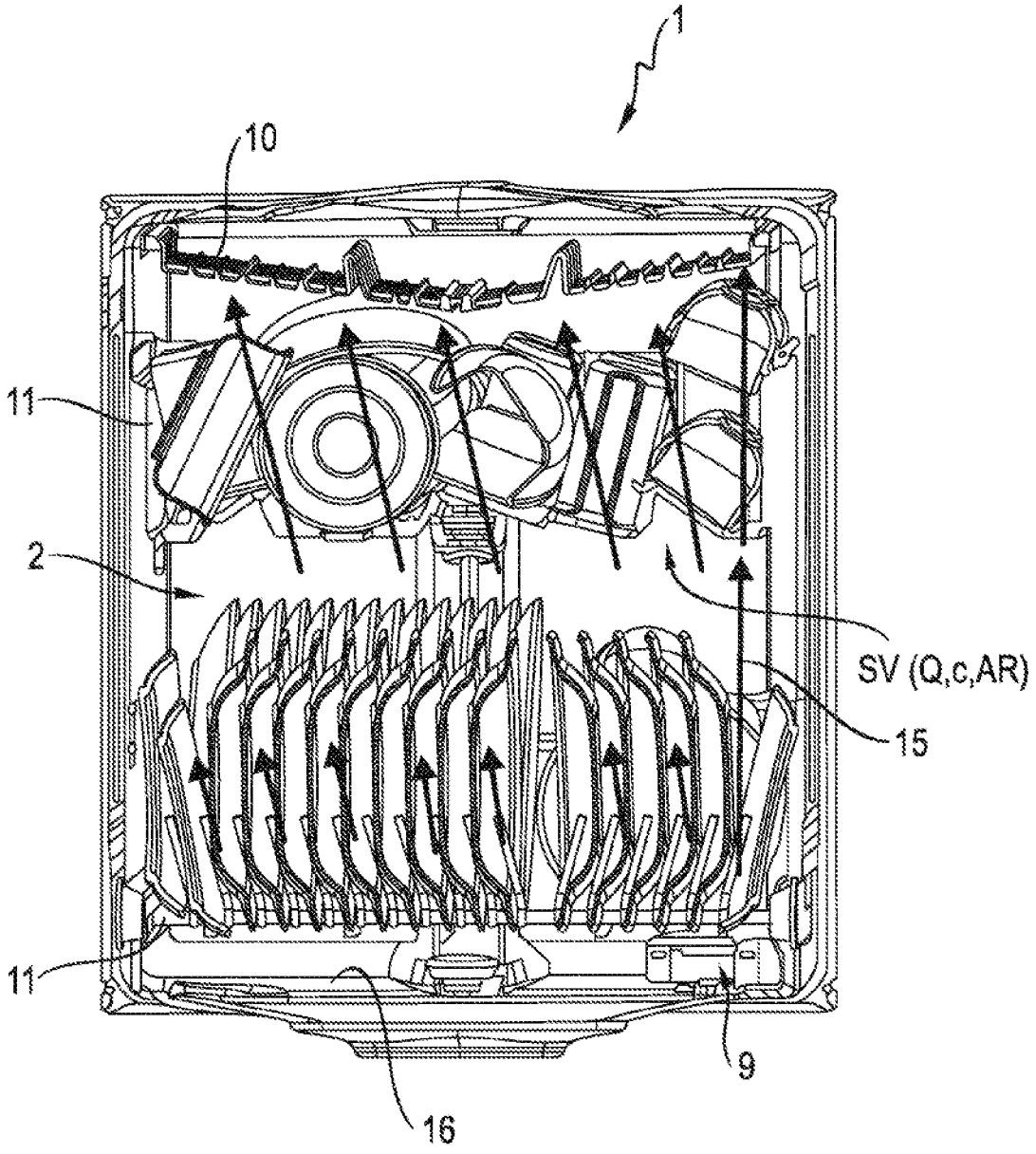
FIG. 8 shows a similar view to the one in FIG. 7 with an alternative flow distribution.

In contrast in FIG. 8 the exit speed c of the air exiting from the discharge opening 9 is lower compared with the local air flow distribution SV in FIG. 7 so the air that has been dried after passing through the sorption material of the sorption drying facility 12 and been heated in the process flows upward with a larger vertical flow component 15 and therefore different regions of the wash container 2 from those in FIG. 7 are supplied more intensively with air.

Figure 6:
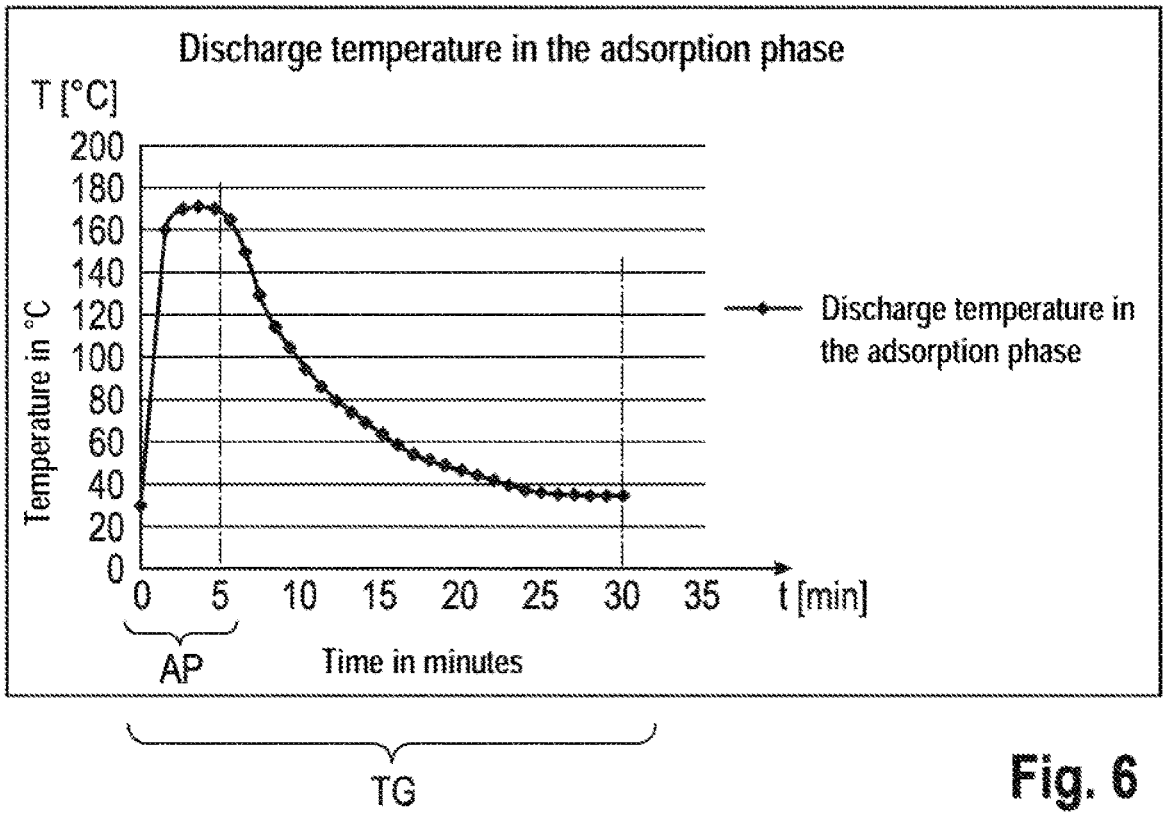
FIG. 6 shows a diagram of the measured discharge temperature of the air in the adsorption phase.
Figure 9:
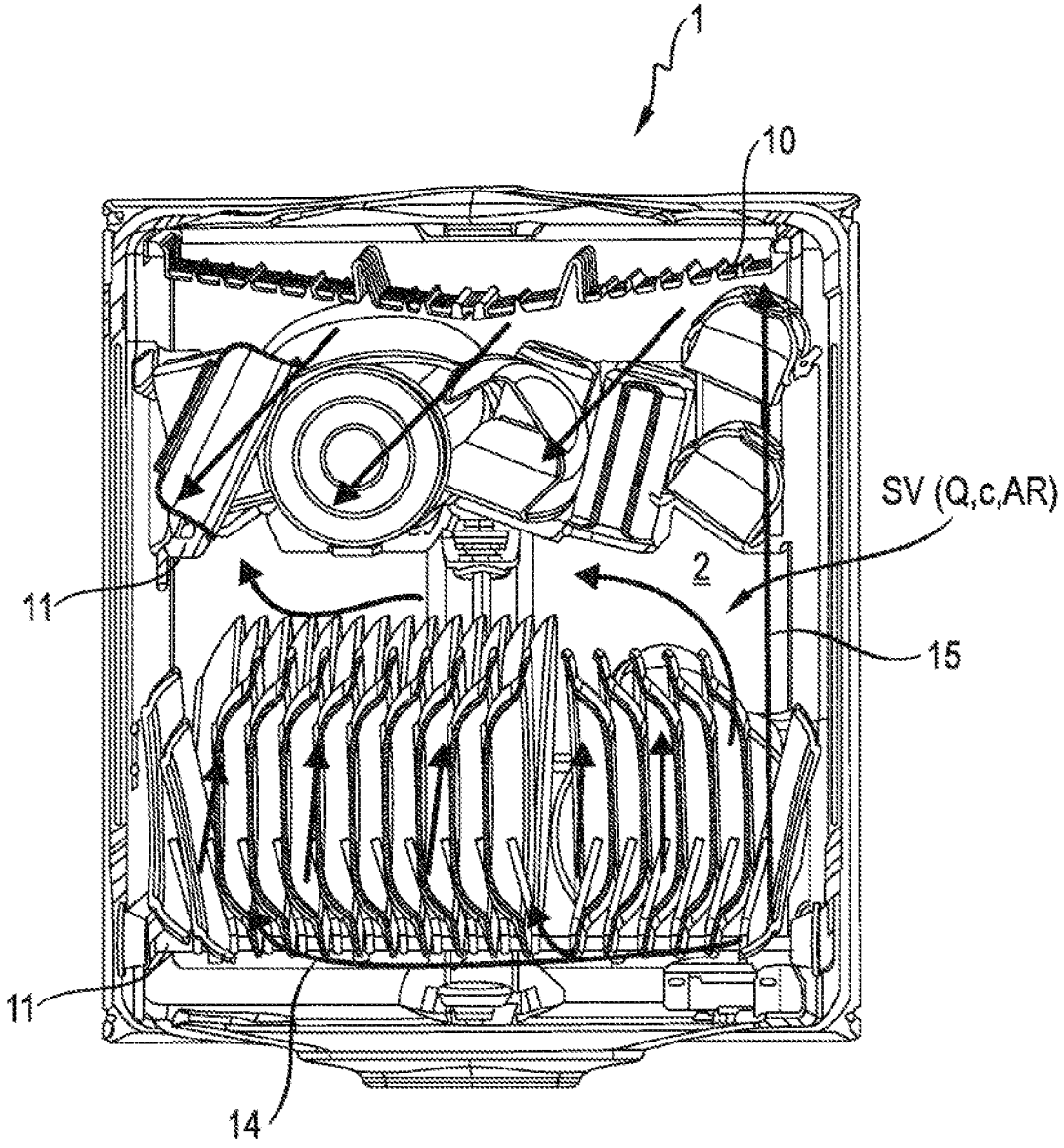
FIG. 9 shows a similar view to the one in FIG. 7 with an alternative flow distribution.

According to the local air flow distribution SV in FIG. 9 there is both a large transverse flow component 14 and a large vertical flow component 15 present, as is possible for example with a high exit speed on the one hand and a high air temperature on the other hand, for example at the start of the drying phase (see FIG. 6).

Figure 10:
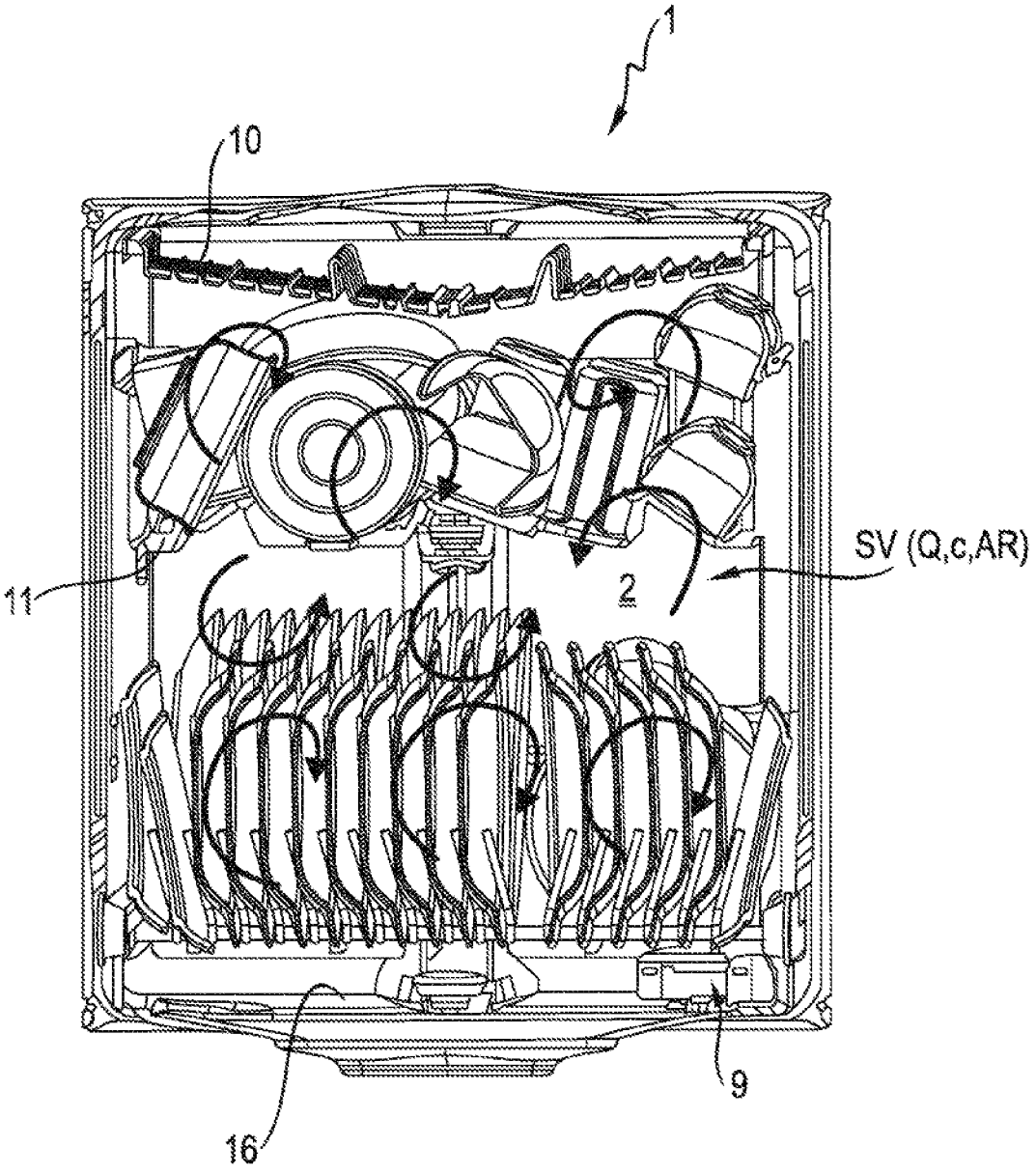
FIG. 10 shows a similar view to the one in FIG. 7 with an alternative flow distribution.

FIGS. 9 and 10 also show how different air flows can form in the wash container. These images can also be snapshots during a volume flow change. Thus the flatware drawer 10 and upper rack 11 are acted on from a flow direction from above—in contrast to FIGS. 7 and 8.

The volume flow and/or the exit speed of the air conducted into the inner chamber of the wash container from the discharge opening is/are preferably varied over the duration of the respective drying phase of a wash cycle so that a turbulent air flow forms in the wash container. This increases the probability of an air flow that is sufficient for drying the items being washed being able to reach or flow over the respective local region in the wash chamber of the wash container.

It is evident how many different and varying air flow distributions are possible within a drying phase, so that many different regions of the inner chamber of the wash container 2 can be reached sometimes with more and sometimes with less air flow intensity and/or from different flow directions RI. Such a change in the volume flow Q and/or exit speed c and/or outflow direction of the air flowing into the wash container by way of the discharge opening mean(s) that it is not important whether for example large elements of items to be washed form obstacles to the air flow in the wash container, as the flow meets and therefore also flows behind such obstacles from different directions.

The described variation of the exit speed of the air from the discharge opening 9, which is associated with a change in the volume flow when the exit cross section remains the same, can be brought about particularly advantageously by way of different rotation speeds DR of a blower connected before the discharge opening 9 or can at least be brought about with the assistance of the latter.

The variation of the volume flow and/or exit speed is expediently controlled here by way of a sequence program, which is preset in a fixed manner by way of a program stored in a, preferably electrical, monitoring facility, in particular a control unit CO (see FIG. 12), of the dishwasher 1. This does not require any data from the ongoing operation; rather the program can be performed without measured input data.

Figure 3:
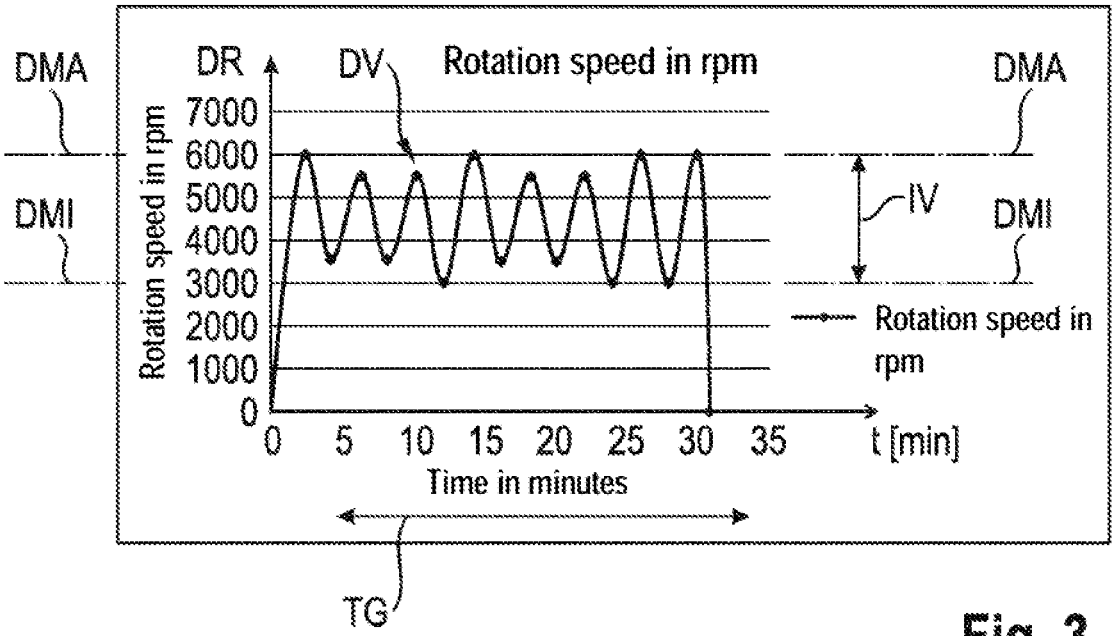
FIG. 3 shows a possible rotation speed profile of a blower for supplying air to the discharge opening during the drying phase.
Figure 4:
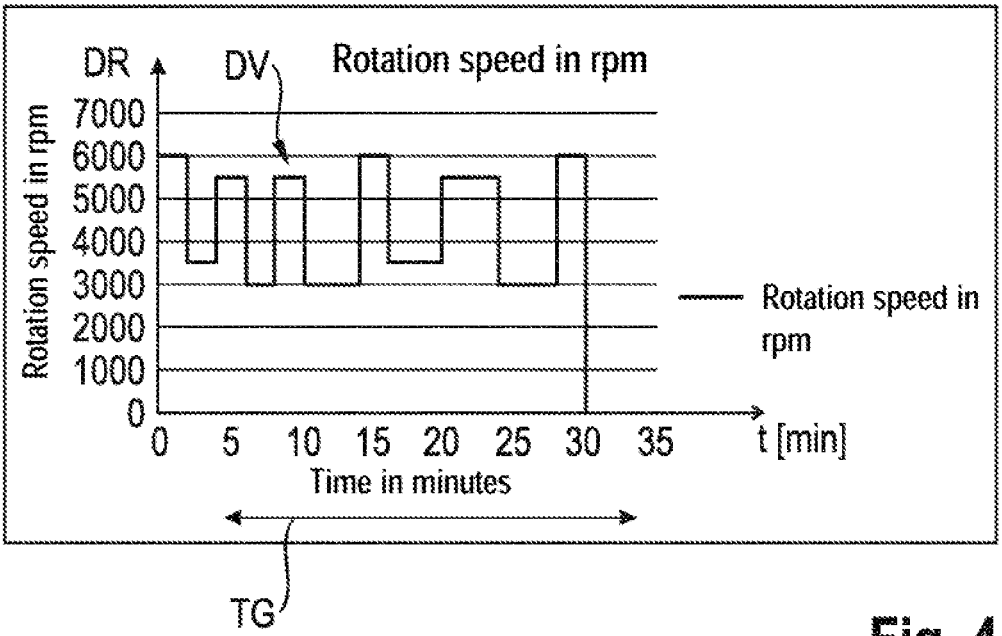
FIG. 4 shows a further possible rotation speed profile of a blower for supplying air to the discharge opening during the drying phase.

Thus according to FIGS. 3 and 4 the rotation speed DR of the blower 17, which changes over time t, is preset in a variable manner over the program sequence.

As is clear from the profiles DV and SV shown there, the rotation speed of the blower 17 is kept within an interval IV between maximum rotation speeds, e.g. DMA (in this instance 6000 rpm), and minimum rotation speeds, e.g. DMI (in this instance 3000 rpm) during the drying phase—apart from a start-up and run-down phase of the blower—so that multiples of 10% variation result from the upper to the lower rotation speed limit (in this instance 50%). Generally in any case the lowest values of the rotation speed DR are more than 5% below the highest values. In this exemplary embodiment the lowest values of the rotation speed DR are in particular more than 1000 revolutions per minute below the highest values and therefore clearly over 5% below the highest values. The fluctuations are therefore significantly above the tolerance fluctuations that are standard in regulating circuits for a constant rotation speed.

At the start of the drying phase TG the rotation speed DR is initially increased to a maximum rotation speed DMA and then reduced to a minimum rotation speed DMI of the interval IV. The high initial rotation speed allows a particularly large quantity of water to be transported out of the wash container in this phase. A sorption drying facility, e.g. 12, in particular absorbs a lot of water and outputs a lot of heat energy in this phase (see FIGS. 5, 6). It is therefore particularly expedient to vary the volume flows a number of times in the initial phase, i.e. during an initial time period AP of the drying phase TG, in order to create an efficient flow round as many regions of the inner chamber of the wash container as possible.

Figure 5:
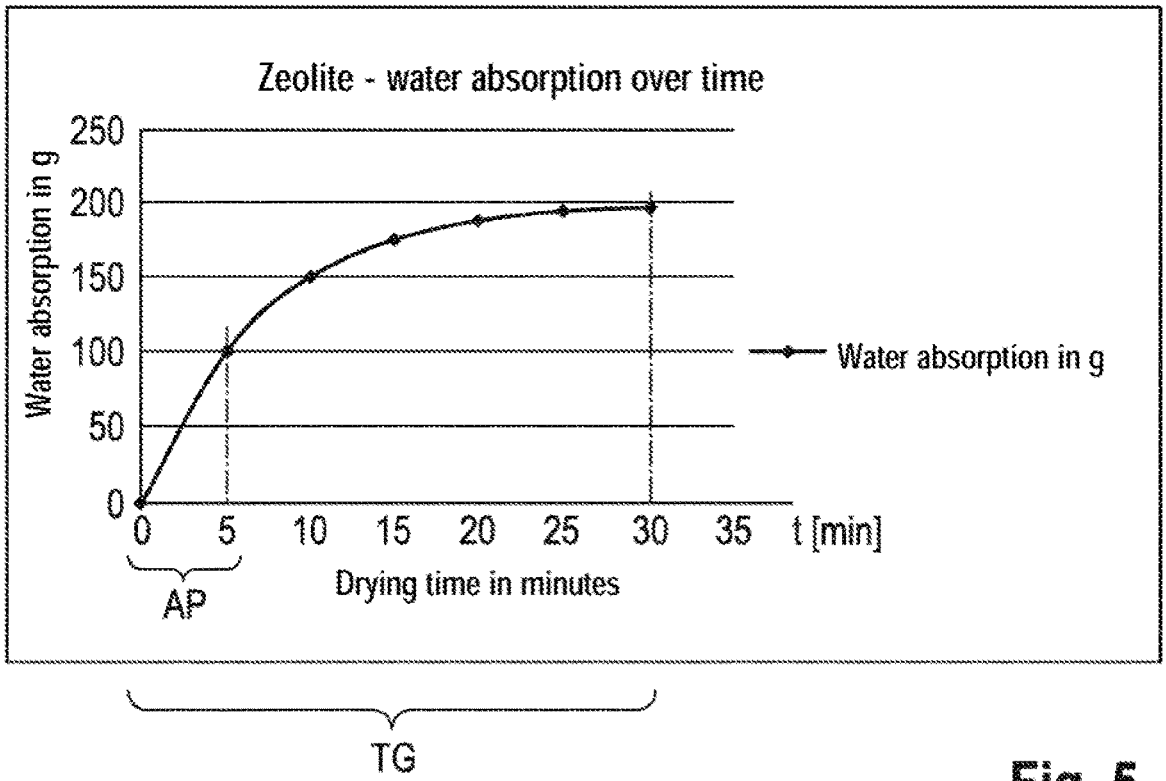
FIG. 5 shows a diagram of the water absorption capacity of zeolite as a sorption drying means over time.

FIG. 5 shows a schematic diagram of the water absorption capacity of zeolite as a sorption material as a function of the progress of drying time t during a drying cycle TG, which lasts for example 30 minutes here. In this exemplary embodiment around half the total quantity of moisture or water that can be adsorbed by the total quantity, in this instance around 200 g, of sorption material in the sorption drying facility 12, is bound in the sorption material, in this instance zeolite, after around 5 minutes from the start time (at t=0 minutes) of the drying cycle TG due to sorption drying. Like FIG. 5, the figure illustrates schematically the profile over time of the discharge temperature T in ° C. of the air, which is blown out of the discharge opening into the wash chamber of the wash container during the drying phase TG, as a function of the time tin minutes. During the initial time period AP of the sorption cycle the air conducted through the sorption drying facility reaches its highest temperature, then dropping until the end of the drying cycle or drying phase TG, in this instance at around 30 minutes.

The first maximum can also be particularly high so that drying is particularly efficient. Further maximums can then be lower to reduce the mean noise level.

The number of times this rotation speed interval is then run through after the initial time period AP can vary. As with a sorption drying facility 12 a particularly large quantity of water is removed in the first minutes (see FIG. 5), it is possible then to go on to operate for example predominantly at the minimum rotation speed, e.g. DMI, of said interval, e.g. IV, also to reduce the noise level and energy consumption. It also allows in particular a shorter rapid drying phase.

In most instances it is favorable if the rotation speed DR of the blower 17 runs through the interval between maximum and minimum rotation speed, e.g. DMA and DMI, at least twice over the drying phase TG. The curve profiles here can vary, as shown in comparison with FIGS. 3 and 4.

According to FIG. 3 the rotation speed profile DV can vary in the manner of a sine curve between highest and lowest values over at least part of the drying phase TG. In contrast according to FIG. 4 the rotation speed profile DV can vary in the manner of a step function between highest and lowest values over at least part of the drying phase. Maximum or minimum rotation speed values can be held over a number of minutes here. Mixed forms or other curve characteristics are also possible. For example it is particularly simple to deploy a sawtooth profile by multiple switching between an upper setpoint rotation speed and a lower setpoint rotation speed of the blower. The rotation speed increases in a substantially linear manner between the lower setpoint rotation speed and the upper setpoint rotation speed. In contrast the rotation speed drops in a substantially linear manner between the upper setpoint rotation speed and the lower setpoint rotation speed.

If a very large number of operating points are passed through, the resulting effect is that a flow is created that is sometimes weaker and sometimes stronger around all the regions of the inner chamber or wash chamber of the wash container 2 and no dead regions remain in the wash chamber.

To reduce the mean noise level of the dishwasher when considered over the total duration of the wash cycle of the dishwashing program to be performed in each instance, it may be particularly expedient for the blower to be controlled in such a manner, in particular by the monitoring facility CO by way of a control line 20, that the higher setpoint rotation speed, e.g. DMA, of the blower is approached for a shorter time segment than the respective lower setpoint rotation speed, e.g. DMI.

It is favorable for the rotation speed DR of the blower 17 to be kept within a (rotation speed value) interval, e.g. IV, between at least one, in particular predefinable, absolute maximum rotation speed, e.g. DMA (see FIG. 3 for example) and at least one absolute minimum rotation speed, e.g. DMI, during the drying phase TG—apart from a start-up and run-down phase of the blower—in other words for it not to drop to zero, so that the drying time period of the drying phase TG is used efficiently. Of course a plurality of further rotation speed values can also be approached and passed through as rotation speed maximums and minimums in the respective rotation speed value interval. Such setpoint rotation speed values are therefore lower than the upper rotation speed limit value, e.g. DMA, and higher than the lower rotation speed limit value DMI of said interval, e.g. IV. The interval can be selected in particular such that the noise level on average is below a set limit value. The independence of the controller means that the noise level is the same every time.

It is particularly favorable for the rotation speed to be first raised to a maximum rotation speed, e.g. DMA, at the start of the drying phase and then to be reduced to a minimum rotation speed, e.g. DMI, of the interval. With the above-mentioned sorption facilities specifically the quantity of water to be removed at the start of the drying phase is particularly large. This can be managed by the particularly high initial rotation speed during an initial time segment of the drying phase or the drying cycle.

The respectively selected minimum rotation speed (lowest value) and maximum rotation speed (highest value) of the rotation speed modification range set for the rotation speed variation is preferably outside the rotation speed range established during the initial starting up or running down of the blower. The minimum rotation speed is in particular selected from a rotation speed range that is different from zero rpm or revolutions per minute, from which the blower can set a desired operating rotation speed in a defined manner. For the fan types generally used for drying in dishwashers it has been demonstrated in tests that a rotation speed DR of at least 1500 revolutions per minute is initially favorable from a regulation perspective. This is because many fans, which have what is known as a PMSM electric motor or permanent magnet synchronous motor, can only be set, in particular be regulated, to a desired rotation speed beyond 1500 revolutions per minute. A value between 3000 and 4000 revolutions per minute is preferably selected for the first, lower setpoint rotation speed (absolute lowest value of the rotation speed variation interval) to be set (see FIG. 3). A value of at least 5000 revolutions per minute, in particular between 5000 and 6000 revolutions per minute, is expedient for the second, upper setpoint rotation speed (highest value of the rotation speed variation interval) (see FIG. 3). The gap between the lower rotation speed and the upper, higher rotation speed is selected in particular to be more than 1000 revolutions per minute. Generally speaking, the respective lowest value of the setpoint rotation speed is expediently more than 5% below the respective highest value of the setpoint rotation speed and therefore significantly above any tolerance fluctuations of a speed-controlled motor. A rotation speed variation between the lowest values and highest values is favorably selected so that it falls within an auditory perception range that is experienced or accepted uncritically by users of dishwashers.

If according to one advantageous development of the invention the rotation speed of the blower passes at least twice through the (rotation speed value) interval between maximum and minimum rotation speed over the drying phase, a major change can be brought about in the air flow so that very different local distributions of the (air) flow in the wash container are achieved. This means that the rotation speed of the blower is switched, in other words varied, a number of times between a first setpoint rotation speed (different from zero) and a second setpoint speed (different from zero) which is different therefrom during the duration of the drying phase.

In particular 2-10 switches between a, preferably predefinable, lower setpoint rotation speed, e.g. DMA, and a, preferably predefinable, upper setpoint rotation speed, e.g. DMI, can be expedient with the blower when considered over the total duration of the drying phase of the respective wash cycle in order to bring about a desired change or variation of the local air flow distribution in the inner chamber of the wash container to a sufficient degree to improve the drying performance of the dishwasher. The time period for the switch between the first setpoint rotation speed and the second setpoint rotation speed, which is different therefrom, is expediently at least 30 secs, in particular between 1 minute and 5 minutes.

In addition to the illustrated volume flow changes with a mechanically unmodified discharge opening 9, control elements can also be used to influence its cross section and/or exit direction in phases. For example a control element can bring about pivoting of the discharge opening 9 about its vertical axis 18.

Figure 11:
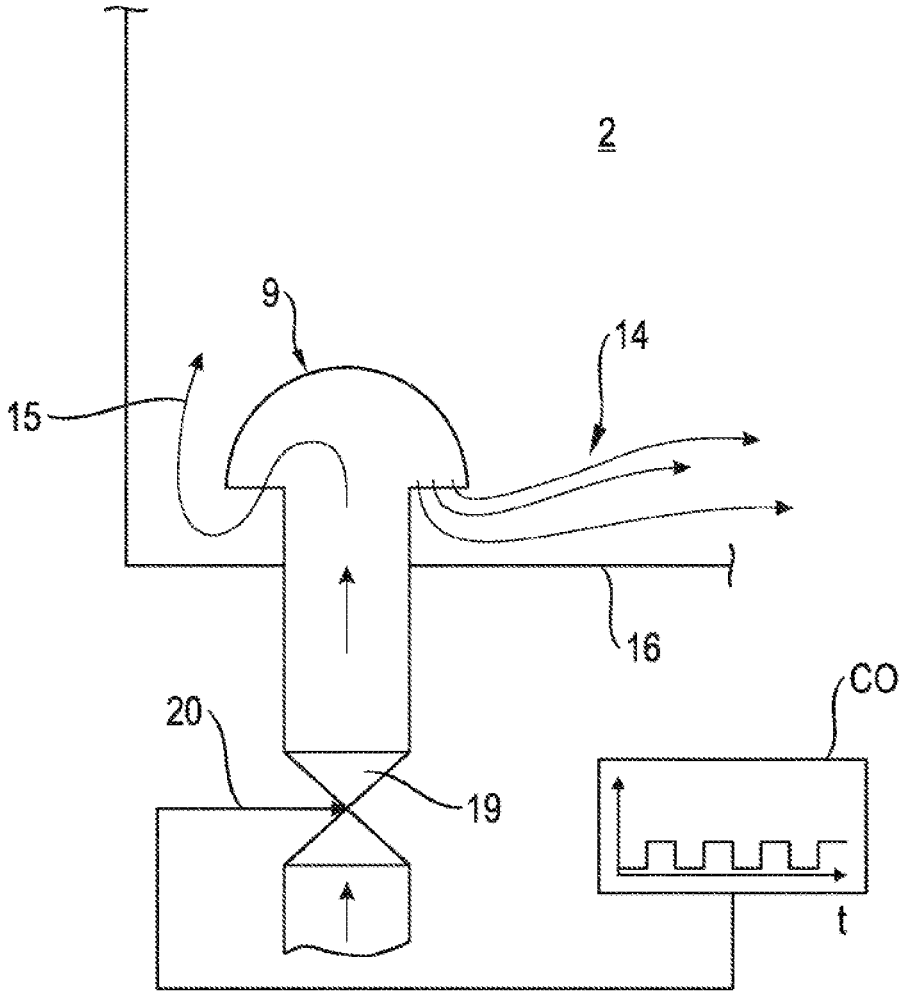
FIG. 11 shows a detailed view of a discharge opening with an upstream closing element.

Additionally or alternatively the volume flow can (also) be varied by way of at least one activatable closing element 19 assigned to the discharge opening 9. This is set out in FIG. 11 and can interrupt the air flow to the discharge opening 9 completely or partially. The switching, in particular the switching on and off, of said closing element 19 can vary periodically or otherwise and is shown in FIG. 11 as a graph over time t. A control line 20 passes from the monitoring facility CO, in particular the control unit, in which programs are stored, to the closing element 19.

Instead of the valve, a sector disk (not shown), which rotates in the air flow and has open and closed regions, can be provided as the closing element 19, rotating continuously for example and thereby alternately (partially) blocking and releasing the air flow. The open regions here can extend to different lengths over the periphery for example. Also this does not require strict periodicity, allowing the opening and closing times to vary over the drying time.

Optionally the volume flow and/or exit speed of the air introduced into the inner chamber of the wash container through the discharge opening can be varied in a simple manner by means of a rotatable disk or some other closing element which only has one opening and is otherwise configured as closed. Depending on whether this one opening is positioned completely over the discharge opening, is positioned only partially over the discharge opening and/or the closed region or cover zone of the closing element covers the discharge opening completely, thereby closing it off, and the time sequence and duration of the opening, partial closing and/or complete closing of the discharge opening, different local air flow distributions are established in the inner chamber of the wash container over the duration of the drying phase.

The drive force of the closing element 19 can be brought about by way of separate control elements. A motor for the blower 17 can also be tapped, for example by way of a reducing gear unit.

The discharge opening 9 can also be assigned at least one movable mechanical control means, for example a baffle, a variable-direction nozzle, a movable flap or the like, so that the exit cross section (and therefore the exit speed of the air) and/or the exit direction AR vary/ies over the duration of the drying phase. This can also change in an alternating manner between extreme positions, so similar curves to the ones in FIGS. 3 and 4 can result for the cross section or discharge direction.

Flaps or the like for example can also be controlled by the varying air flow itself, so that they align themselves by means of the different volume flows.

FIG. 12 shows such a supplementary configuration, in which a control line 20 controls the blower speed and a further control line 20 is provided to influence the discharge opening 9. Additionally a third control line 20 can influence a switching element 22 at the air outlet from the wash container 2, in other words in the region of the air outlet opening 23 of the wash container and/or the intake opening of the air duct 24, in order sometimes to block air with an overpressure by closing and sometimes to bring about free passage.

Point 21 in the wash container shows by way of example how flow vectors can vary in quantity, in particular in respect of volume flow value and/or flow speed, and direction RI over the drying time.

The invention therefore allows more efficient drying for the same energy input, while making the drying process independent of the respective load.

The solution is particularly customer oriented and reduces noise levels by reducing rotation speeds and deploying the blower 17 at different operating points without losing efficiency.

LIST OF REFERENCE CHARACTERS

1 Dishwasher
2 Processing container
3 Door
4 Pivot direction
5 Carcass
6 Decorative panel
7 Grip opening
8 Operating panel
9 Discharge opening
10 Flatware drawer
11 Rack
12 Sorption drying facility
13 Air flow
14 Transverse flow component
15 Vertical flow component
16 Base of wash container
17 Blower
18 Vertical axis
19 Closing element
20 Control line
21 Point in wash container
22 Switching element
23 Air outlet opening
24 Air duct
AR Exit direction
DR Rotation speed
DV Rotation speed profile as a function of time HZ Heating facility
RI Flow direction
SV Local air distribution or flow distribution
Q Volume flow or air throughput
c Exit speed
CO Monitoring facility, in particular control unit
VS Front face
QR Transverse direction

The invention claimed is:

1. A dishwasher, comprising:

a wash container for cleaning dishes, glasses, flatware or similar items to be washed during a program sequence including a drying phase or another process phase, said wash container having a loading opening closable by a door;

an air inlet opening for inflow of a volume flow of air, the air inlet opening being disposed in a member that projects into an inner chamber of the wash container from a base of the wash container so as to communicate with the wash container;

a blower positioned upstream of the air inlet opening for providing a flow of air to the air inlet opening;

an activatable closing element positioned downstream of the blower and being positioned in the member immediately below the air inlet opening so as to communicate with the air inlet opening for varying the volume flow of air and/or the speed of air; and a controller configured to store a sequence program to control a variation of the volume flow of air and/or the speed of air, wherein the controller is configured to control both the blower and the activatable closing element in order to vary said volume flow of air entering the wash container through the air inlet opening, such that said volume flow of air entering the wash container through the air inlet opening fluctuates a plurality of times over the drying phase or the other process phase.

2. The dishwasher of claim 1, constructed as a domestic dishwasher.

3. The dishwasher of claim 1, wherein the air inlet opening is a discharge opening for discharging air from the blower and into the wash container.

4. The dishwasher of claim 1, wherein air enters the wash container through the air inlet opening at a speed which varies a number of times at the air inlet opening during the drying phase or the other process phase.

5. The dishwasher of claim 4, wherein a variation of the volume flow of air and/or the speed of air causes variation of a local flow distribution of air in the wash container a number of times during the drying phase or the other process phase.

6. The dishwasher of claim 1, wherein the sequence program is configured to preset the variation of the volume flow of air and/or the speed of air.

7. The dishwasher of claim 1, wherein the sequence program is configured for execution in the absence of measured input data.

8. The dishwasher of claim 1, further comprising a sorption drying facility arranged upstream of the air inlet opening.

9. The dishwasher of claim 8, wherein during the drying phase air which has passed through the sorption drying facility is introducible into the wash container.

10. The dishwasher of claim 8, wherein the other process phase is a desorption phase for the sorption drying facility.

11. The dishwasher of claim 1, wherein the blower is configured to vary the volume flow of air and/or the speed of air by changing a rotation speed of the blower.

12. The dishwasher of claim 11, wherein the rotation speed of the blower is preset in a variable manner in the program sequence.

13. The dishwasher of claim 12, wherein a profile of the rotation speed is variable in the form of a sawtooth or a sine profile between highest and lowest values over at least a sub-segment of the drying phase or the other process phase.

14. The dishwasher of claim 12, wherein a profile of the rotation speed is variable in the form of a step function between highest and lowest values over at least part of the drying phase or the other process phase.

15. The dishwasher of claim 12, wherein a lowest value of the rotation speed is more than 5% below a highest value of the rotation speed.

16. The dishwasher of claim 12, wherein the controller is configured to keep the rotation speed of the blower in an interval between a maximum rotation speed and a minimum rotation speed during the drying phase or the other process phase apart from a start-up and run-down phase of the blower.

17. The dishwasher of claim 16, wherein the maximum and minimum rotation speeds are predefined.

18. The dishwasher of claim 16, wherein the controller is configured to first raise the rotation speed to the maximum rotation speed at a start of the drying phase or the other process phase and then to reduce to the minimum rotation speed in the interval.

19. The dishwasher of claim 16, wherein the rotation speed of the blower passes at least twice through the interval between the maximum and minimum rotation speeds during the drying phase or the other process phase.

20. The dishwasher of claim 1, wherein the activatable closing element comprises a movable mechanical control member configured in the form of a baffle, a variable-direction nozzle, or a movable flap and communicating with the air inlet opening.

21. The dishwasher of claim 20, wherein the control member is configured to control a direction of air flow into the wash container.

* * * * *